United States Patent [19]

Grachtrup

[11] Patent Number: 4,554,876

[45] Date of Patent: Nov. 26, 1985

[54] ROTARY KILN WITH COOLER

[75] Inventor: Heinz Grachtrup, Ennigerloh, Fed. Rep. of Germany

[73] Assignee: Krupp Polysius AG, Beckum, Fed. Rep. of Germany

[21] Appl. No.: 602,051

[22] Filed: Apr. 19, 1984

[30] Foreign Application Priority Data

May 9, 1984 [DE] Fed. Rep. of Germany ..... 3316974

[51] Int. Cl.[4] ..... F23G 5/06

[52] U.S. Cl. ..... 110/246; 110/165 R; 432/80; 432/115

[58] Field of Search ..... 110/165 R, 165 A, 166, 110/246; 432/3, 77, 80, 115

[56] References Cited

U.S. PATENT DOCUMENTS

| | | | |
|---|---|---|---|
| 2,461,754 | 2/1949 | Mertz | 432/115 |
| 2,611,330 | 9/1952 | Kirk | 432/3 |
| 2,960,943 | 11/1960 | Andersen | 110/246 |
| 3,539,164 | 11/1970 | Brachthauser | 432/80 |
| 3,927,960 | 12/1975 | Endersen | 432/80 |

FOREIGN PATENT DOCUMENTS

| | | | |
|---|---|---|---|
| 577378 | 10/1977 | U.S.S.R. | 432/115 |
| 616504 | 7/1978 | U.S.S.R. | 432/115 |

*Primary Examiner*—Albert J. Makay
*Assistant Examiner*—Steven E. Warner
*Attorney, Agent, or Firm*—Learman & McCulloch

[57] ABSTRACT

A rotary kiln has a sealable separating gap between the kiln outlet head and an inlet shaft leading to a cooler. In order that the shortest possible drop height for the fired material falling out of the discharge end of the rotating cylinder may be maintained despite the separating gap, interengaging steps and side openings defined thereby are formed in the side walls of the kiln outlet head and the inlet shaft, and sections of the separating gap which run at different heights open into the side openings and the horizontal distance between any two steps lying opposite one another corresponds approximately to the maximum displacement path of the kiln outlet head.

8 Claims, 2 Drawing Figures

ROTARY KILN WITH COOLER

The invention relates to a rotary kiln having a cooler and wherein the kiln comprises a rotary cylinder provided with a stationary outlet head.

BACKGROUND OF THE INVENTION

It is part of the general state of the art that material fired in a rotary kiln is passed via a stationary kiln outlet head associated with the outlet end of the rotating cylinder and an inlet shaft positioned below it to a cooler arranged after the rotary kiln. One end of the stationary kiln outlet head surrounds the edge region of the end of the rotating cylinder facing it to a sufficient extent to ensure adequate sealing in this region. At the connection point between this kiln outlet head and the inlet shaft a sealable separating gap is provided in such a way that alterations in the length of the kiln attributable to the effects of temperature and resulting displacement of the kiln outlet head can be largely accommodated.

In such a rotary kiln and cooler assembly it must be ensured that the shortest possible drop is maintained for the material falling from the end of the rotating cylinder into the cooler. This is on the one hand because with a relatively long drop the dust pollution in the air rising in counterflow to the fired material is undesirably high (excessive dust pollution in the firing process or in the associated dust separators), and on the other hand because the fired material frequently falls out of the end of the rotating cylinder in relatively large and heavy lumps and can lead to considerable mechanical stress on impact with the cooling equipment. Although in the case of rotary kilns with relatively small dimensions the drop height for the fired material generally remains within acceptable limits and the separating gap to be sealed between the kiln outlet head and the cooler inlet shaft can be arranged to run approximately horizontally (so that as a rule sufficient movability of the kiln outlet head can be ensured during operation), in the case of larger rotary kilns considerable problems frequently occur in maintaining the acceptable drop height for the fired material. In order to keep this drop height as small as possible, in the case of larger rotary kilns there has been a changeover in practice to constructing the separating gap at the connection point between the kiln outlet head and the inlet shaft so that it runs at an angle, and as a result the end of the inlet shaft opposed to the outlet end of the rotating cylinder is correspondingly higher and the appertaining end wall of the kiln outlet head is correspondingly lower so that the drop height can be kept relatively small. However, this inclined separating gap only permits a very restricted movability of the kiln outlet head in the longitudinal direction of the kiln, which brings certain disadvantages with it: if the rotating cylinder is excessively elongated (due to heating) sufficient compensation therefor cannot always be ensured with the necessary reliability by the movability of the head, and attention must be paid to ensure that the inclined separating gap which has to accommodate the longitudinal expansion of the kiln during the compensation must at the same time seal the connection point between the kiln outlet head and the inlet shaft and therefore must not be excessively large, although on the other hand if it is not wide enough it can restrict the possibility of longitudinal expansion or compensation therefor by the kiln outlet head; because of this limited movability of the kiln outlet head the collar thereof which engages over the end of the rotating cylinder must be capable of being dismantled in sections so that the relevant end of the rotating cylinder is accessible for maintenance work.

An object of the invention, therefore, is to construct a rotary kiln of the type referred to and in which the transitional region to its cooler enables, in a simple manner, a relatively small drop height for the fired material to be maintained even with larger kiln dimensions and sufficient movability of the kiln outlet head.

SUMMARY OF THE INVENTION

In the construction according to the invention the step formations on both sides of the kiln outlet head and the cooler inlet shaft in each case produce a closable side opening of equal size, and the side openings on both sides of the kiln outlet head and the inlet shaft can lie opposite one another. These closable side openings on the one hand ensure sufficient movability of the kiln outlet head in the longitudinal direction of the kiln (far enough for the outlet end of the rotating cylinder to be made freely accessible for maintenance purposes), and on the other hand together with the sections of the separating gap located at different heights they provide for a sufficiently short drop height for the fired material possible since the end of the cooler inlet shaft opposite the end of the rotary kiln can be made comparatively high.

THE DRAWINGS

Further details of the invention are set out in the following description of a presently preferred embodiment illustrated in the drawings, wherein:

FIG. 1 is a longitudinal sectional view taken on the line I—I of FIG. 2 and the transitional region between the rotary kiln and the cooler; and FIG. 2 is a cross-sectional view along the line II—II in FIG. 1.

DETAILED DESCRIPTION

The drawings essentially show only those parts which are essential to an understanding of the invention. Thus, such devices as a burner lance, the rotary kiln drive and mounting, and cooler drive and associated blower, and separating arrangements are omitted for the sake of clarity.

Figure 1:
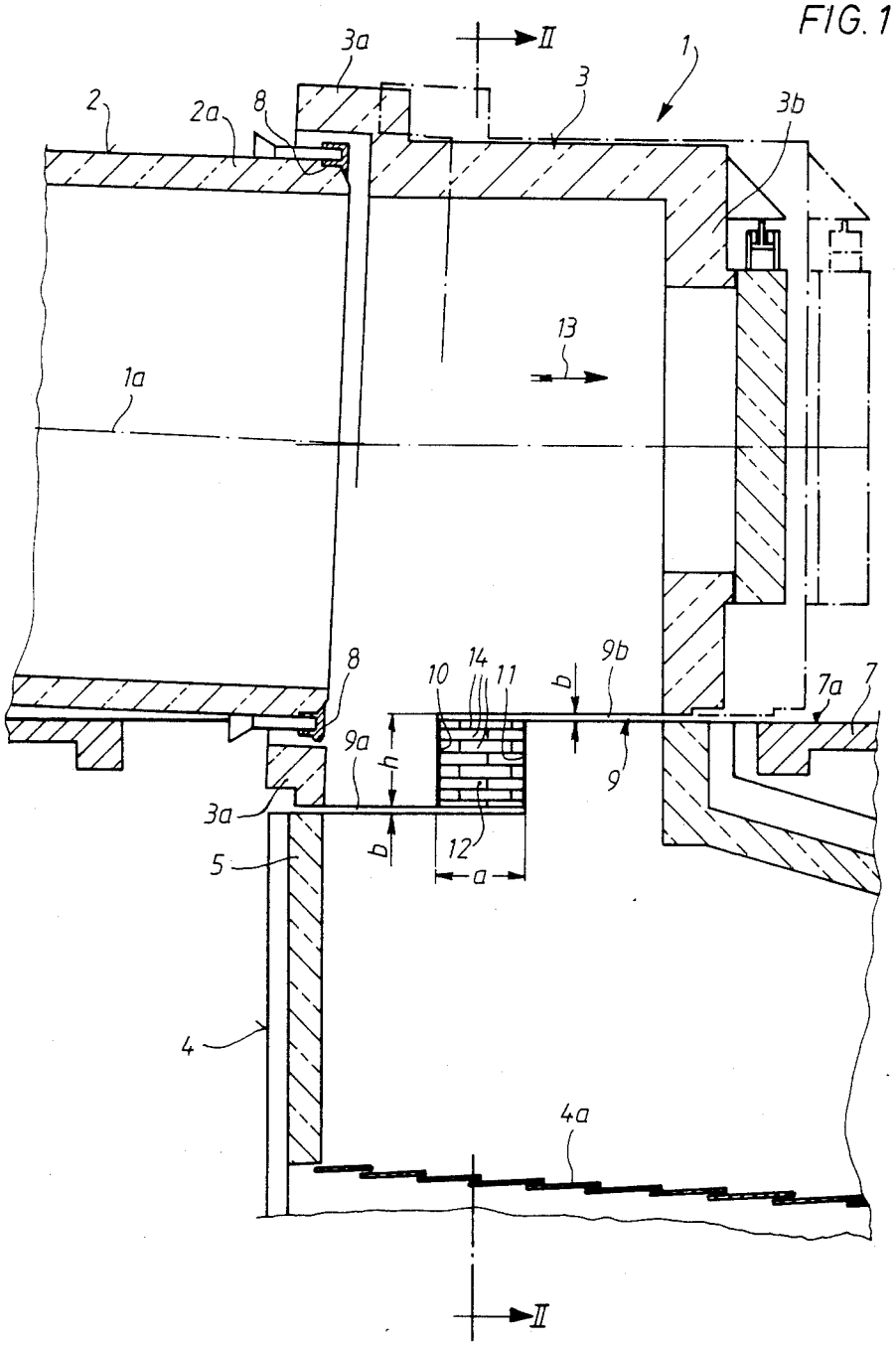

Of the rotary kiln 1, FIG. 1 shows the rotatably mounted rotating cylinder 2 with its outlet end 2*a* and the stationary kiln outlet head 3 associated with the end 2*a*. A cooler 4 which is connected to the kiln outlet head 3 by an inlet shaft 5 is arranged after or downstream from the rotary kiln 1. The inlet shaft 5 in the illustrated embodiment constitutes a part of the cooler itself, but it can also be constructed as a separate inlet shaft between the actual cooler inlet and the kiln outlet head. In FIG. 1 the cooler 4 is shown in the form of a thrust grating cooler; however, the cooler can be of any other suitable construction, for example a traveling grate cooler, a cooling drum, and the like.

Figure 2:
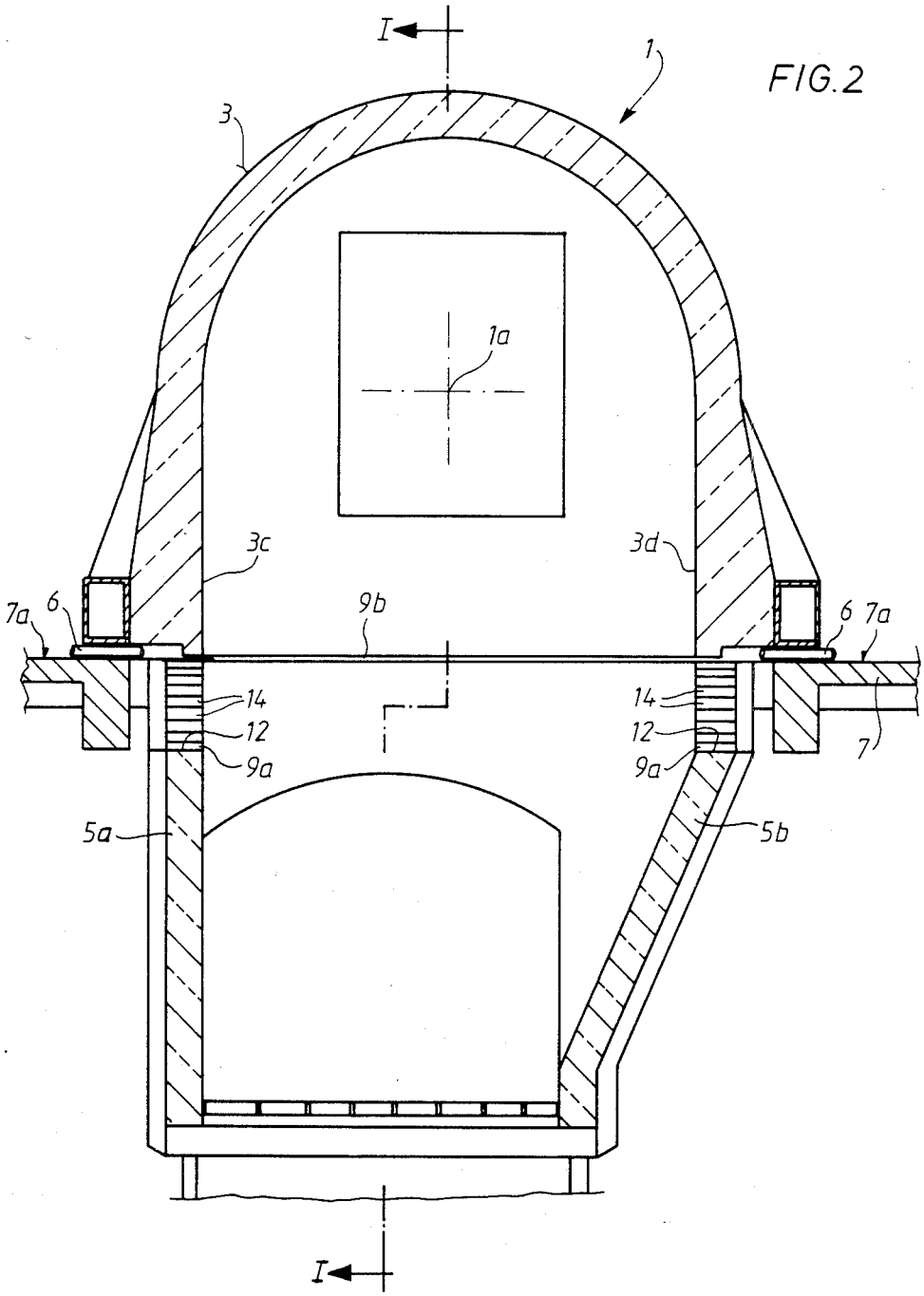

As indicated in FIG. 2, the stationary kiln outlet head 3 is mounted on rollers 6 for limited movement in the longitudinal direction of the rotary kiln 1 (see longitudinal axis 1*a* of the kiln), and is supported by means of these rollers 6 on a base which is formed by the upper face 7*a* of a cover 7 of the structure which is provided here. The end of the kiln outlet head 3 facing the end 2*a* of the rotating cylinder is constructed in the form of a collar part 3*a* which encloses the edge region of the end 2a of the rotating cylinder like a ring with its protective segments 8 which are provided there in the usual way, so that a type of seal, as is generally known, is produced. The burner lance (not shown) can be introduced in the usual manner into the outlet end 2a of the rotating cylinder through the opposing rear end wall 3b of the kiln outlet head 3.

A separating gap 9 which is divided into two sections 9a, 9b is provided at the connection point between the kiln outlet head 3 and the cooler inlet shaft 5 (that is to say on the underside of the kiln outlet head and on the upper end of the inlet shaft). The purpose of the separating gap is explained in greater detail below.

The side walls 3c, 3d, or 5a, 5b respectively of the kiln outlet head 3 and the cooler inlet shaft 5 are constructed in the region of the connection point with interengaging steps 10 or 11 which extend approximately vertically and are essentially of equal height so that the steps 10 in the side walls 3c, 3d of the kiln outlet head 3 correspond approximately to and interengage with the steps 11 in the side walls 5a, 5b of the inlet shaft 5. As can be seen clearly in FIG. 1, the two steps 10, 11 which lie opposite one another are a horizontal distance a from each other on each long side of the kiln outlet head 3 and the inlet shaft 5 so that between these steps 10, 11 a side opening 12 is formed in each case. The horizontal breadth of each of the openings 12 corresponds to the distance a and the vertical height h thereof corresponds approximately to the height of the steps 10, 11. The horizontal distance a between the two opposing steps 10, 11 also corresponds in the operating position of the kiln outlet head 3, shown by solid lines in FIG. 1, to the maximum displacement path of this kiln outlet head 3 in the direction of the arrow 13, that is to say if—when the rotary kiln 1 is at a standstill—the kiln outlet head 3 is pushed away from the end 2a of the rotating cylinder, as is indicated in FIG. 1 by dot-dash lines. This displacement of the kiln outlet head 3 is necessary for example in order to make the outlet end 2a of the rotating cylinder and the protective segments 8 provided there accessible for maintenance purposes. In the operating state of the rotary kiln and thus in the operating position of the kiln outlet head 3, on the other hand, the horizontal distance a is produced, as mentioned above, between the steps 10, 11, but the two side openings 12 formed between the two steps 10, 11 are lined with removable fireclay bricks 14. This fireclay brick lining makes it possible on the one hand to close the side openings 12 adequately during operation of the kiln and on the other hand, by removal of the fireclay bricks, to open the side openings 12 rapidly in case of need in order to bring about the full movability of the kiln outlet head by the distance a. The maximum displacement path (distance a) of the kiln outlet head 3 is advantageously adapted to the size for free accessibility in the region between the kiln outlet head 3 and the outlet end 2a of the rotating cylinder 2.

Even though the provision of several of the steps is conceivable in the region of each long side of the kiln outlet head 3 and the inlet shaft 5, it is quite sufficient for the desired movability if only one correspondingly high step 10 or 11 and a side opening 12 formed between them is provided in each side wall 3c, 3d or 5a, 5b of the kiln outlet head 3 and the inlet shaft 5 respectively.

The construction and the course of the separating gap with its sections 9a, 9b are also important. The course and the arrangement of the sections 9a, 9b of the separating gap and their association with each side opening 12 are particularly clearly shown in FIG. 1. According to this the lower-lying section 9a of the separating gap runs at one level in the region below the outlet end 2a of the rotating cylinder and extends horizontally from the region of the ends facing the rotating cylinder 2 below the collar part 3a and opens directly into the lower end of the two side openings 12. By contrast, the section 9b of the separation gap lying at the upper level lies approximately at the height of the base 7a of the kiln outlet head 3 and extends horizontally out of the region of the ends (e.g. 3b) opposite the end 2a of the rotating cylinder and opens directly into the upper end of the side openings 12. In this way an uninterrupted displacement of the kiln outlet head 3 is made possible, and above all it is ensured that the kiln outlet head 3 on the one hand can completely engage with its collar part 3a under the end 2a of the rotating cylinder, but on the other hand can also be displaced by means of the rollers 6 on the appertaining cover 7 of the structure so that with a comparatively large degree of movability in the direction of the arrow 13 the drop height of the fired material falling out of the end 2a of the rotating cylinder onto the cooler grating 4a can be kept as small as possible, i.e., within acceptable limits. Each section 9a or 9b of the separating gap runs at its own level approximately over the whole associated peripheral section, i.e. in the embodiment illustrated in FIG. 1 with side openings 12 arranged approximately in the region of the center of the length each section 9a or 9b of the separating gap runs approximately over half the periphery in the region of the connection point. The height b of the separating gap 9 is such that adequate compensation can be made in this region too for vertical expansion caused by the effects of temperature. The separating gap 9 is advantageously sealed by means of a conventional ceramic fiber seal.

What is claimed is:

1. In a rotary kiln and cooler assembly having a rotatable cylinder, a stationary kiln outlet head associated with the outlet end of the cylinder and capable of limited displacement relative to the outlet end of the cylinder, and an inlet shaft connecting the kiln outlet head to the cooler, and wherein a sealable separating gap is provided at the connection between the kiln outlet head and the inlet shaft, the improvement wherein said kiln outlet head and said inlet shaft have side walls at said connection provided with approximately vertical interengaging steps of equal height, adjacent ones of said steps lying opposite one another and being movable toward and away from one another a distance to form a closable side opening at each side of said kiln outlet head, and wherein the separating gap is divided by said steps into at least two horizontal sections of different heights which open into the side openings.

2. A rotary kiln according to claim 1 wherein said side openings are lined with refractory material.

3. A rotary kiln according to claim 2 wherein said refractory material is removable.

4. A rotary kiln according to claim 1 wherein only one step is provided in each side wall of the kiln outlet head and the inlet shaft, and only one side opening is provided between them.

5. A rotary kiln according to claim 4 wherein said separating gap has a lower lying section in the region below the outlet end of the rotating cylinder that opens into the lower end of the side openings, and an upper section lying at approximately the height of the base of the kiln outlet head and opening into the upper end of the side openings.

6. A rotary kiln according to claim 1 wherein the maximum displacement path of the kiln outlet head is adapted in size for free access in the region between the kiln outlet head and the outlet end of the rotating cylinder.

7. A rotary kiln according to claim 1 including means for sealing the separating gap.

8. A rotary kiln according to claim 7 wherein said sealing means comprises a ceramic fiber seal.

* * * * *